US008793904B2

(12) United States Patent
Friton

(10) Patent No.: US 8,793,904 B2
(45) **Date of Patent: *Aug. 5, 2014**

(54) ARTICLE OF FOOTWEAR WITH DUAL LACING SYSTEM

(75) Inventor: Michael R. Friton, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 112 days.

This patent is subject to a terminal disclaimer.

(21) Appl. No.: 13/404,175

(22) Filed: Feb. 24, 2012

(65) Prior Publication Data

US 2012/0151798 A1 Jun. 21, 2012

Related U.S. Application Data

(63) Continuation of application No. 11/566,584, filed on Dec. 4, 2006, now Pat. No. 8,146,271.

(51) Int. Cl.

| | |
|---|---|
| ***A43C 1/00*** | (2006.01) |
| ***A43C 11/00*** | (2006.01) |
| ***A43C 11/14*** | (2006.01) |

(52) U.S. Cl.

CPC ..... *A43C 1/00* (2013.01); *A43C 11/008* (2013.01); *A43C 11/1493* (2013.01)

USPC ..... 36/50.1; 24/712.1

(58) Field of Classification Search

CPC ..... A43C 1/00; A43C 1/003; A43C 7/00; A43C 11/008; A43C 11/1493

USPC ..... 36/50.1, 50.5, 51; 24/712.1, 712.5, 24/713.6

See application file for complete search history.

(56) References Cited

U.S. PATENT DOCUMENTS

| | | | | |
|---|---|---|---|---|
| 2,321,754 | A | 6/1943 | Koehler | |
| 4,079,527 | A | 3/1978 | Antonious | |
| 5,016,327 | A | 5/1991 | Klausner | |
| D337,425 | S | 7/1993 | Hatfield | |
| 5,349,764 | A | 9/1994 | Posner | |
| 5,511,325 | A | 4/1996 | Hieblinger | |
| 5,755,044 | A | 5/1998 | Veylupek | |
| 6,757,991 | B2 | 7/2004 | Sussmann | |
| 6,941,683 | B2 | 9/2005 | Freed | |
| 7,073,279 | B2 | 7/2006 | Min | |
| 7,908,769 | B2 * | 3/2011 | Pellegrini | 36/50.1 |
| 2005/0081403 | A1 | 4/2005 | Mathieu | |
| 2006/0185193 | A1 | 8/2006 | Pellegrini | |
| 2008/0127511 | A1 | 6/2008 | Friton | |
| 2009/0038128 | A1 | 2/2009 | Cho | |

FOREIGN PATENT DOCUMENTS

| | | |
|---|---|---|
| WO | 0035308 | 6/2000 |

* cited by examiner

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear including a dual lacing system is disclosed. The article of footwear includes a first lace and a second lace. The first lace and the second lace include portions that are interdigitated, these portions being disposed towards an entry hole of the upper. The laces also include provisions for releasably fastening to the sides of the article of footwear.

21 Claims, 5 Drawing Sheets

ARTICLE OF FOOTWEAR WITH DUAL LACING SYSTEM

CROSS-REFERENCE TO RELATED APPLICATIONS

This application is a continuation of U.S. Patent Publication Number US2008/0127511 A1, published Jun. 5, 2008 (U.S. application Ser. No. 11/566,584, filed Dec. 4, 2006), which is herein incorporated by reference in its entirety.

BACKGROUND OF THE INVENTION

1. Field of the Invention

The present invention relates generally to footwear, and in particular an article of footwear with a dual lacing system.

2. Description of Related Art

Articles of footwear generally include some kind of provision that allows the article to be opened to allow entry of a wearer's foot, and to be closed so that the article is secured to the wearer's foot. In the past, lacing systems have been used. In particular, lacing systems incorporating a hook and loop fastening system have been proposed.

Posner (U.S. Pat. No. 5,349,746) teaches a shoe with a securement apparatus. In the design of Posner, laces are secured through a shoe by a plurality of guides and indentations along the ankle portion of the shoe. These guides and indentations take up the slack of a shoelace that includes mating material attached to the ends and which is secured to a shoe by mating surfaces attached to the guides and indentations. In other words, the user may tighten the laces in a usual fashion, and then wrap the laces along the indentations and guides disposed along the ankle portion to secure the laces and keep portions of the laces from falling to the ground.

Veylupek (U.S. Pat. No. 5,755,044) also teaches a lacing system that allow a user to releasably attach the ends of the lace to the shoe. Each lace is connected to a tab having a section of hook or loop material designed for engagement with a mating section of material along the rear of the shoe. In other words, the user may tighten the laces by pulling back tabs that are connected to the laces and securing the tabs in place along a hook or loop fastening region along the rear of the shoe.

A drawback to the designs of Posner and Veylupek is that they rely on a single lace for securing the upper to a wearer's foot. Using a single lace in this manner may not give the wearer enough control to tighten multiple regions over which the lace is disposed. Generally, there is a need for articles of footwear including multiple laces.

Footwear including multiple laces with attachment regions for the laces along the sides of the footwear have been proposed. Mathieu (U.S. patent number 2005/0081403) teaches a boot including a lacing device. The lacing device comprises at least two independent successive zones of lacing. This configuration of successive lacing zones allows for differential adjustment and tightening of the lacing zones. Mathieu also teaches a shoe with a single attachment region disposed along one side of the shoe for attaching the ends of the laces.

While Mathieu teaches footwear including multiple laces, there are many shortcomings. The lacing device of Mathieu lacks overlapping laces that may add strength to the lacing system. Additionally, the design of Mathieu lacks aesthetic appeal. There is a need in the art for an article of footwear including a dual lacing system that fastens to attachment regions along the sides of footwear that overcomes these problems.

SUMMARY OF THE INVENTION

An article of footwear including a dual lacing system is disclosed. In one aspect, the invention provides an article of footwear, comprising: an upper, including a first lace and a second lace; the second lace including a middle portion disposed between a first portion and a second portion of the second lace; the first lace including a first end and a second end; and where the first end and the second end of the first lace are each associated with the middle portion of the second lace.

In another aspect, the first lace and the second lace are different lengths.

In another aspect, the first lace is longer than the second lace.

In another aspect, the first portion of the second lace includes a second fastener.

In another aspect, the second fastener is a hook or loop fastener.

In another aspect, the second portion of the second lace includes a first fastener.

In another aspect, the first fastener is a hook or loop fastener.

In another aspect, the invention provides an article of footwear, comprising: an upper, including a lacing region; a first lace and a second lace; and where the first lace includes a first intermediate portion disposed along a first diagonal of the lacing region and a second intermediate portion disposed along a second diagonal of the lacing region.

In another aspect, the first lace and the second lace are different lengths.

In another aspect, the first lace is longer than the second lace.

In another aspect, the first portion of the second lace includes a second fastener.

In another aspect, the second fastener is a hook or loop fastener.

In another aspect, the second portion of the second lace includes a first fastener.

In another aspect, the first fastener is a hook or loop fastener.

In another aspect, the invention provides an article of footwear, comprising: an upper, including a first lace and a second lace; the first lace including a first long portion and the second lace including a second long portion, each portion being disposed between a first attachment region and the upper; the first lace including a third long portion and the second lace including a fourth long portion, each portion being disposed between a second attachment region and the upper; and where the first long portion, the second long portion, the third long portion and the fourth long portion are interdigitated.

In another aspect, the first attachment region is disposed near a lateral side of the upper.

In another aspect, the second attachment region is disposed near a medial side of the upper.

In another aspect, the upper includes slots disposed along the medial side of a lacing region configured to receive the first lace and the second lace.

In another aspect, the upper includes slots disposed along the lateral side of a lacing region configured to receive the first lace and the second lace.

In another aspect, the upper includes six slots disposed along the lacing region.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
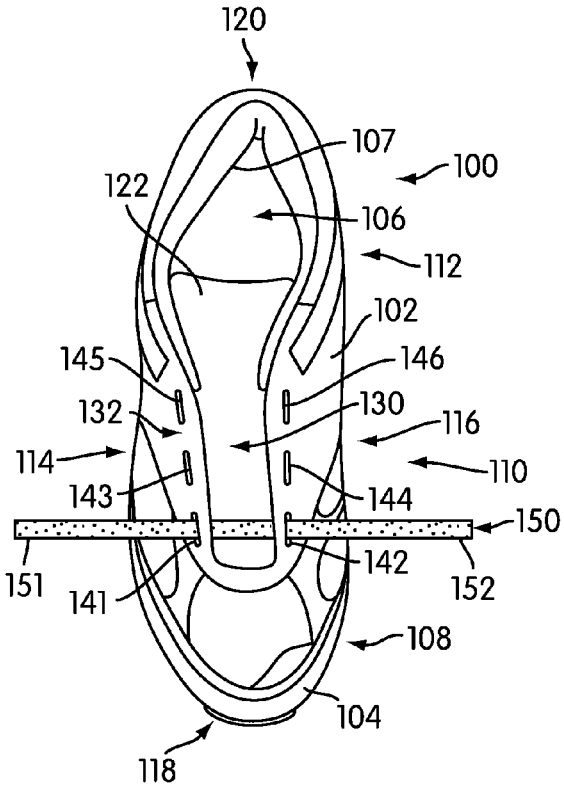
FIG. 1 is a schematic diagram of a preferred embodiment of an article of footwear with a first lace.

FIG. 1 is a preferred embodiment of an article of footwear 100 in the form of an athletic shoe. For clarity, the following detailed description discusses a preferred embodiment, however, it should be kept in mind that the present invention could also take the form of any other kind of footwear including, for example, skates, boots, ski boots, snowboarding boots, cycling shoes, formal shoes, slippers, or any other kind of footwear.

Preferably, article of footwear 100 includes upper 102. Article of footwear 100 also preferably includes outsole 104. In some embodiments, upper 102 may be constructed of a variety of materials. Examples of upper materials include, but are not limited to, leather, cloth, synthetic materials, or any other material. In a preferred embodiment, upper 102 may be constructed of several materials chosen from the previous list of materials.

Generally, article of footwear 100 may be divided into three regions including forefoot region 108, central region 110, and heel region 112. Upper 102 also preferably includes lateral side 114 and medial side 116, as well as front side 118 and rear side 120.

In some embodiments, upper 102 may include entry hole 106. Entry hole 106 is preferably configured to allow a wearer's foot to enter upper 102. In a some embodiments, entry hole 106 may include periphery 107. In a preferred embodiment, entry hole 106 may be associated with heel region 112.

Preferably, upper 102 may also include tongue 122. Tongue 122 may be associated with entry hole 106. In some embodiments, tongue 122 may be disposed adjacent to entry hole 106. In a preferred embodiment, tongue 122 may be moved or folded in order to increase the size of entry hole 106, allowing the wearer to more easily insert their foot into upper 102.

In some embodiments, upper 102 may include provisions for tightening upper 102 to a wearer's foot. In some embodiments, upper 102 may include lacing region 130. Lacing region 130 is preferably disposed in central region 110. Specifically, lacing region 130 is preferably associated with throat opening 132 of upper 102.

Generally, lacing region 130 may include holes or slots configured to receive laces of some kind. In some embodiments, lacing region 130 may include a set of slots disposed along medial side 116 and lateral side 114 of upper 102. In a preferred embodiment, lacing region 130 may include first slot 141, second slot 142, third slot 143, fourth slot 144, fifth slot 145, and sixth slot 146.

In some embodiments, first slot 141 and second slot 142 may be disposed adjacent to front side 118 of upper 102. First slot 141 is preferably disposed along lateral side 114, while second slot 142 is preferably disposed along medial side 116 of upper 102. On the other side of lacing region 130, fifth slot 145 and sixth slot 146 are preferably disposed adjacent to entry hole 106 of upper 102. Fifth slot 145 is preferably disposed along lateral side 114, while sixth slot 146 is preferably disposed along medial side 116 of upper 102. Additionally, third slot 143 is preferably disposed between first slot 141 and fifth slot 145 along lateral side 114. Likewise, fourth slot 144 is preferably disposed between second slot 142 and sixth slot 146 along medial side 116.

Preferably, first lace 150 may be inserted through first slot 141 and second slot 142 of lacing region 130. In some embodiments, first lace 150 may include first end 151 and second end 152. Originally, first end 151 of first lace 150 may be disposed adjacent to lateral side 114 of upper 102. Similarly, second end 152 may be disposed adjacent to medial side 116 of upper 102. However, as first lace 150 is inserted through additional slots, the positions of first end 151 and second end 152 may vary.

Figure 2:
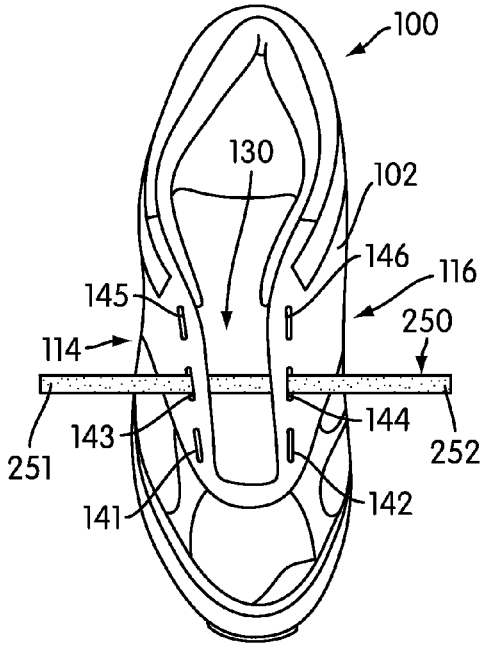
FIG. 2 is a schematic diagram of a preferred embodiment of an article of footwear with a second lace.
Figure 3:
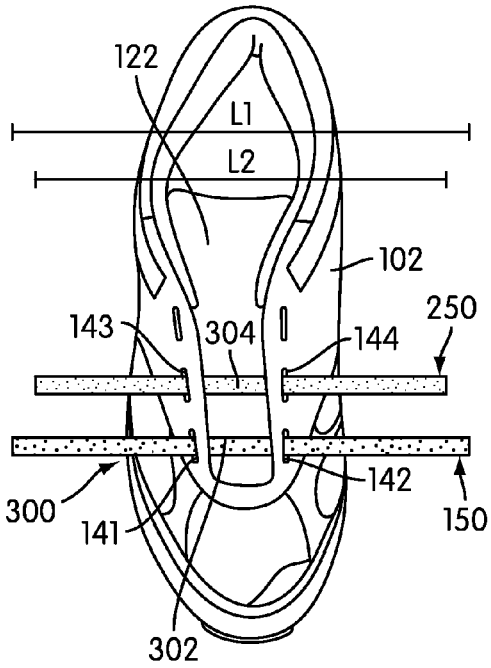
FIG. 3 is a schematic diagram of a preferred embodiment of an article of footwear with the first lace and the second lace.

Referring to FIGS. 2 and 3, upper 102 preferably includes a second lace that is independent of the first lace. In some embodiments, second lace 250 may be inserted through third slot 143 and fourth slot 144 of lacing region 130. In some embodiments, second lace 250 may include first end 251 and second end 252. Originally, first end 251 of second lace 250 may be disposed adjacent to lateral side 114 of upper 102. Likewise, second end 252 may be disposed adjacent to medial side 116. However, as second lace 250 is inserted through additional slots, the positions of first end 251 and second end 252 may vary.

Lacing region 130, including both first lace 150 and second lace 250 will be referred to as dual lacing system 300 throughout the rest of the disclosure. In particular, dual lacing system 300 refers to the use of first lace 150 and second lace 250, in combination, to tighten upper 102 around a wearer's foot.

First lace 150 and second lace 250 may be inserted simultaneously. Preferably, first lace 150 may be inserted into first slot 141 and second slot 142, as previously discussed. Likewise, second lace 250 may be inserted into third slot 143 and fourth slot 144.

Generally, first lace 150 may include first base portion 302, disposed between first slot 141 and second slot 142. In a similar manner, second lace 250 may include second base portion 304, disposed between third slot 143 and fourth slot 144. Preferably, first base portion 302 is disposed against tongue 122, and second base portion 304 may also be disposed against tongue 122.

In some embodiments, first lace 150 and second lace 250 may be different lengths. In some embodiments, first lace 150 may have a length L1. In some embodiments, second lace 250 may have a length L2. In a preferred embodiment, L1 is greater than L2. In other words, first lace 150 is preferably longer than second lace 250.

In a preferred embodiment, first lace 150 and second lace 250 may be flat. In particular, first lace 150 and second lace 250 may be strap-like. Generally, however, first lace 150 and second lace 250 need not be flat. In some embodiments, first lace 150 and second lace 250 may be rounded, similar to traditional types of laces.

Figure 4:
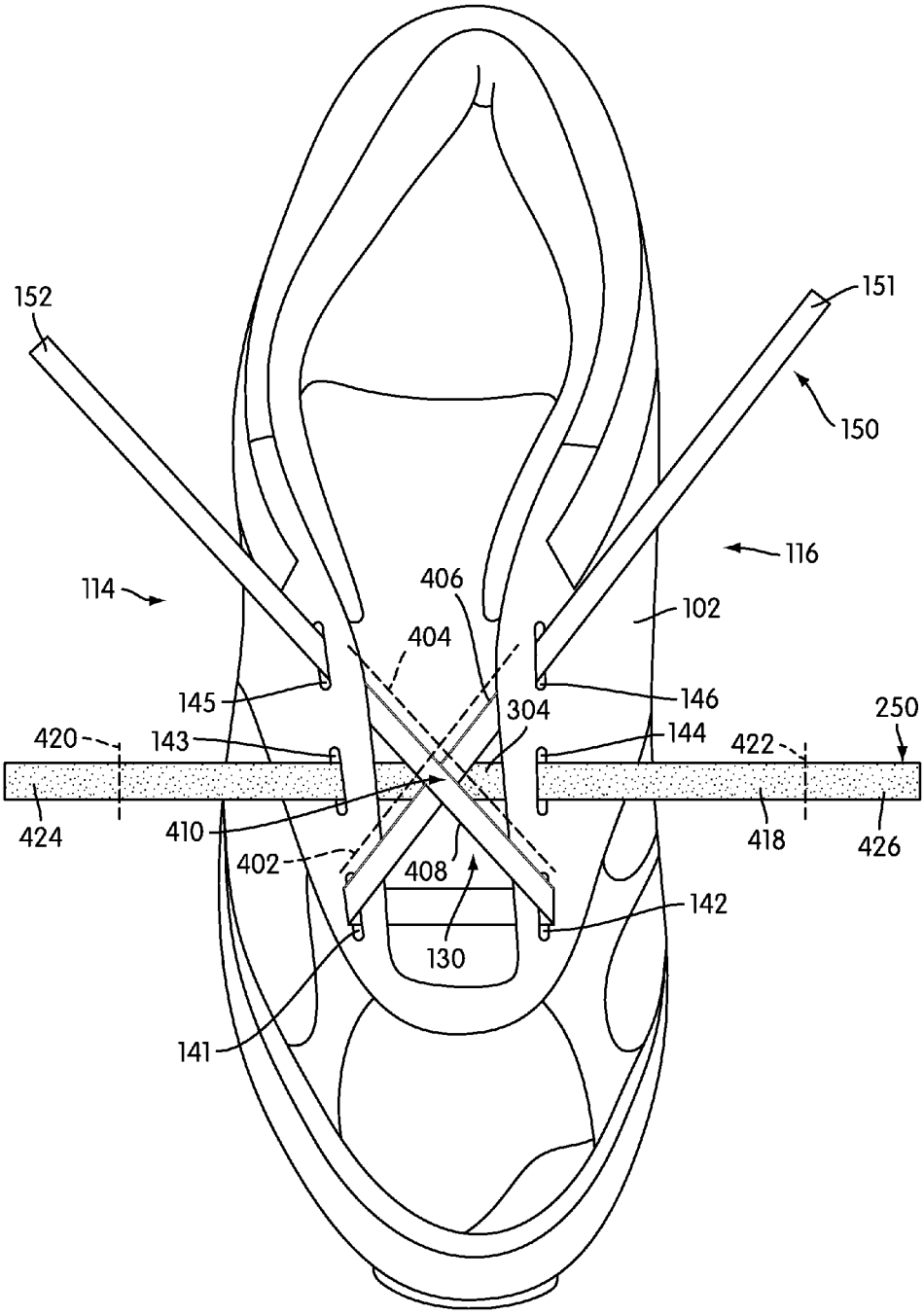
FIG. 4 is a schematic diagram of a preferred embodiment of an article of footwear with the first lace inserted along a portion of a lacing region.
Figure 5:
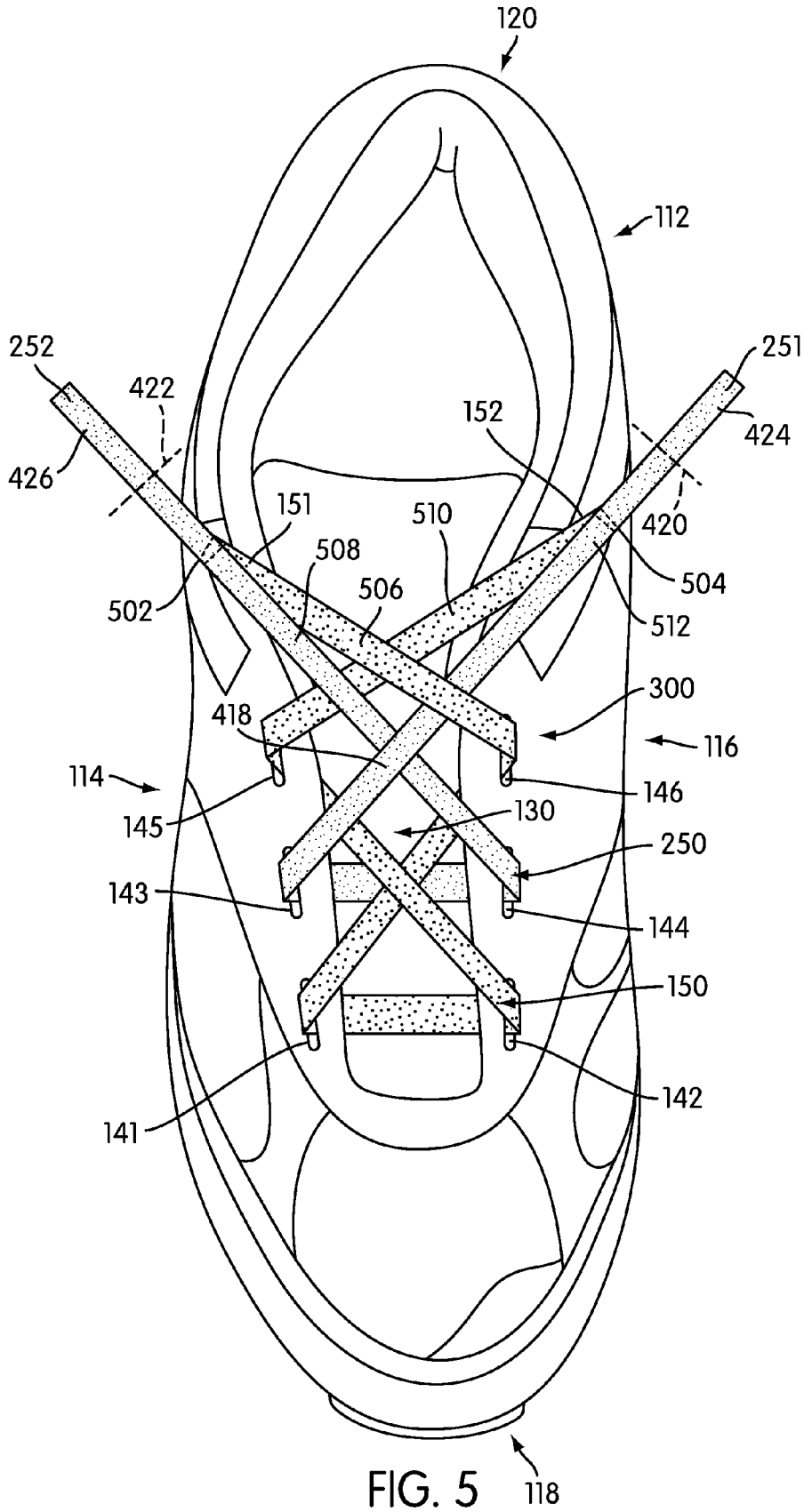
FIG. 5 is a schematic diagram of a preferred embodiment of an article of footwear with the first lace connected to the second lace.

The lacing of first strap 150 and second strap 250 to form dual lacing system 300 is best understood with reference to FIGS. 4-5. In some embodiments, second lace 250 preferably remains in place while first lace 150 is inserted through additional slots. In some embodiments, first end 151 of first lace 150 is preferably inserted through sixth slot 146. In this manner, first intermediate portion 406 of first lace 150 may be disposed along a first diagonal 402 of lacing region 130. Here, first diagonal 402 represents a straight line between first slot 141 and sixth slot 146. Generally, a diagonal of lacing region 130 may be any line disposed across opposing corners of lacing region 130.

In a similar manner, second end 152 of first lace 150 is preferably inserted through fifth slot 145 of lacing region 130. Preferably, second intermediate portion 408 of first lace 150 may be disposed along a second diagonal 404 of lacing region 130. Here, second diagonal 404 represents a straight line between second slot 142 and fifth slot 145. Preferably, second intermediate portion 408 of first lace 150 may be disposed over first intermediate portion 406 of first lace 150 at first intersection 410. Additionally, first intermediate portion 406 of first lace 150 may be disposed over second base portion 304 of second lace 250. It can also be observed that second intermediate portion 408 of first lace 150 may be disposed over second base portion 304 of second lace 250.

Generally, second lace 250 may include three portions, including first portion 424, second portion 426, and middle portion 418. In some embodiments, middle portion 418 is disposed between first portion 424 and second portion 426 of second lace 250. In a preferred embodiment, the boundary between first portion 424 and middle portion 418 is first edge 420. Similarly, the boundary between second portion 426 and middle portion 418 is preferably second edge 422.

Once first lace 150 has been inserted through fifth slot 145 and sixth slot 146, second end 152 of first lace 150 may be brought across lacing region 130 from lateral side 114 to medial side 116, as seen in FIG. 5. Next, second end 252 of second lace 250 may be brought across lacing region 130 from medial side 116 to lateral side 114. Following this, first end 251 of second lace 250 may be brought across lacing region 130, from lateral side 114 to medial side 116. Finally, first end 151 of first lace 150 may be brought across lacing region 130, from medial side 116 to lateral side 114.

At this point, first end 151 of first lace 150 is preferably associated with middle portion 418 of second lace 250 adjacent to second edge 422. In some embodiments, first end 151 of first lace 150 may be attached to middle portion 418 of second lace 250. In a preferred embodiment, first end 151 of first lace 150 may be stitched to middle portion 418 of second lace 250 at first attachment region 502.

In a similar manner, second end 152 of first lace 150 is preferably associated with middle portion 418 of second lace 250 adjacent to first edge 420. In some embodiments, second end 152 of first lace 150 may be attached to middle portion 418 of second lace 250. In a preferred embodiment, second end 152 of first lace 150 may be stitched to middle portion 418 of second lace 250 at second attachment region 504.

Preferably, first lace 150 includes first long portion 506, which may be disposed between first attachment region 502 and sixth slot 146. Second lace 250 may preferably include second long portion 508, which may be disposed between first attachment region 502 and fourth slot 144. In a similar manner, first lace 150 also preferably includes a third long portion 510, which may be disposed between second attachment region 504 and fifth slot 145. Second lace 250 also preferably includes fourth long portion 512, which may be disposed between second attachment region 504 and third slot 143.

Generally, long portions 506, 508, 510 and 512 may overlap. In some embodiments, third long portion 510 may be disposed below second long portion 508. Also, in some embodiments, fourth long portion 512 may be disposed above second long portion 508 and below first long portion 506. In this arrangement, long portions 506, 508, 510 and 512 may be referred to as interdigitated.

In a preferred embodiment, the interdigitation of long portions 506, 508, 510 and 512 facilitates the ease of use of dual lacing system 300. This is due to the nature of the interdigitation. Since long portions 506, 508, 510 and 512 are interlocked they cannot be pulled apart because of first attachment region 502 and second attachment region 504. This keeps first end 251 of second lace 250 adjacent to medial side 116 of heel region 112. Likewise, this arrangement keeps second end 252 of second lace 250 adjacent to lateral side 114 of heel region 112. Therefore, first lace 150 and second lace 250 will tend not to drift to different sides of the upper, as traditional laces may do when not in use. This allows a user to quickly grab the ends of the lacing system and fasten them in place immediately.

Preferably, dual lacing system 300 includes provisions for fastening the first lace and the second lace. In some embodiments, the laces may be attached to the sides of the article of footwear in order to securely fasten them in place. Preferably, the second lace includes provisions for adjustably fastening to regions disposed along the medial and lateral sides of the heel region. This configuration allows for speed of use over traditional lacing systems in which the laces are tied together.

Figure 6:
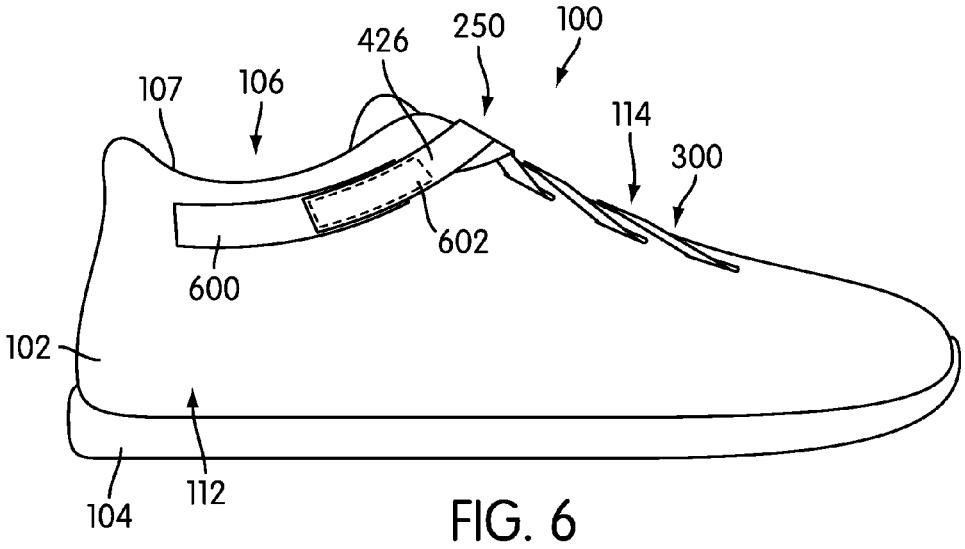
FIG. 6 is a side view of a preferred embodiment of an article of footwear with a first fastening region.

Referring to FIG. 6, second portion 426 of second lace 250 may be pulled along lateral side 114 of upper 102 to adjust dual lacing system 300. Preferably, upper 102 includes a first fastening region 600 disposed along lateral side 114 of heel region 112. In some embodiments, first fastening region 600 may be disposed adjacent to periphery 107 of entry hole 106. In a preferred embodiment, first fastening region 600 may be a hook or loop fastener.

In some embodiments, second portion 426 of second lace 250 may include a first fastener 602 (shown here in phantom). Preferably, first fastener 602 may be a hook or loop fastener. In this manner, first fastener 602 may be fastened directly to first fastening region 600. Adjusting the region of overlap between first fastener 602 and first fastening region 600 preferably varies the tension of dual lacing system 300.

Figure 7:
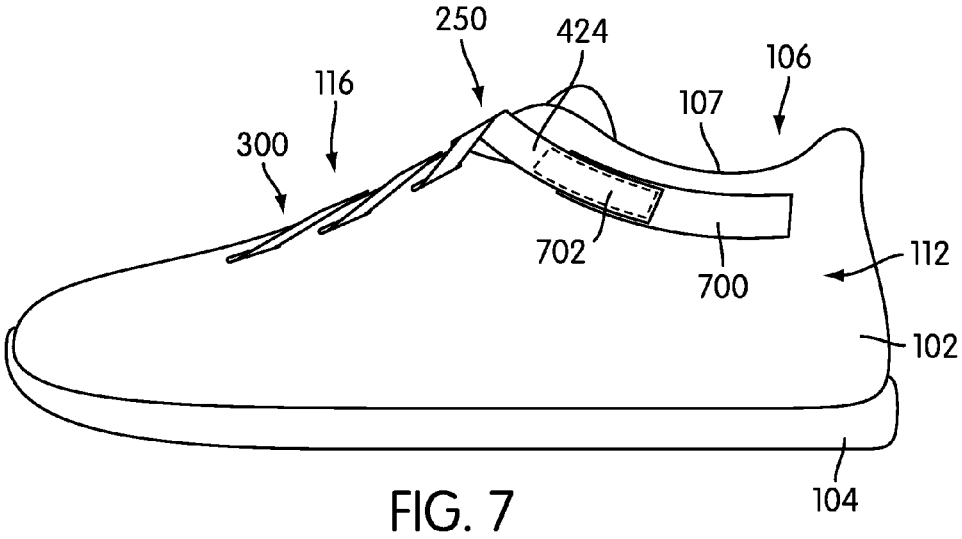
FIG. 7 is a side view of a preferred embodiment of an article of footwear with a second fastening region.

FIG. 7 is a side view of a preferred embodiment of medial side 116 of upper 102. Preferably, first portion 424 of second lace 250 may be pulled along medial side 116 of upper 102 to adjust dual lacing system 300. In some embodiments, upper 102 may include a second fastening region 700 disposed along medial side 116 of heel region 112. In some embodiments, second fastening region 700 may be disposed adjacent to periphery 107 of entry hole 106. In a preferred embodiment, second fastening region 700 may be a hook or loop fastener.

In some embodiments, first portion 424 of second lace 250 may include second fastener 702 (shown here in phantom). Preferably, second fastener 702 may be a hook or loop fastener. In this manner, second fastener 702 may be fastened directly to first fastening region 700. Adjusting the region of overlap between second fastener 702 and second fastening region 700 preferably varies the tension of dual lacing system 300.

Although in a preferred embodiment first fastener 602, second fastener 702, first fastening region 600 and second fastening region 700 may all be components of a hook or loop fastening system (such as Velcro©), other embodiments may incorporate other types of fasteners. Generally, any type of releasable fastener may be used. Preferably, the releasable fastener may be adjusted to various lengths to accommodate different degrees of tension applied to dual lacing system 300.

Figure 8:
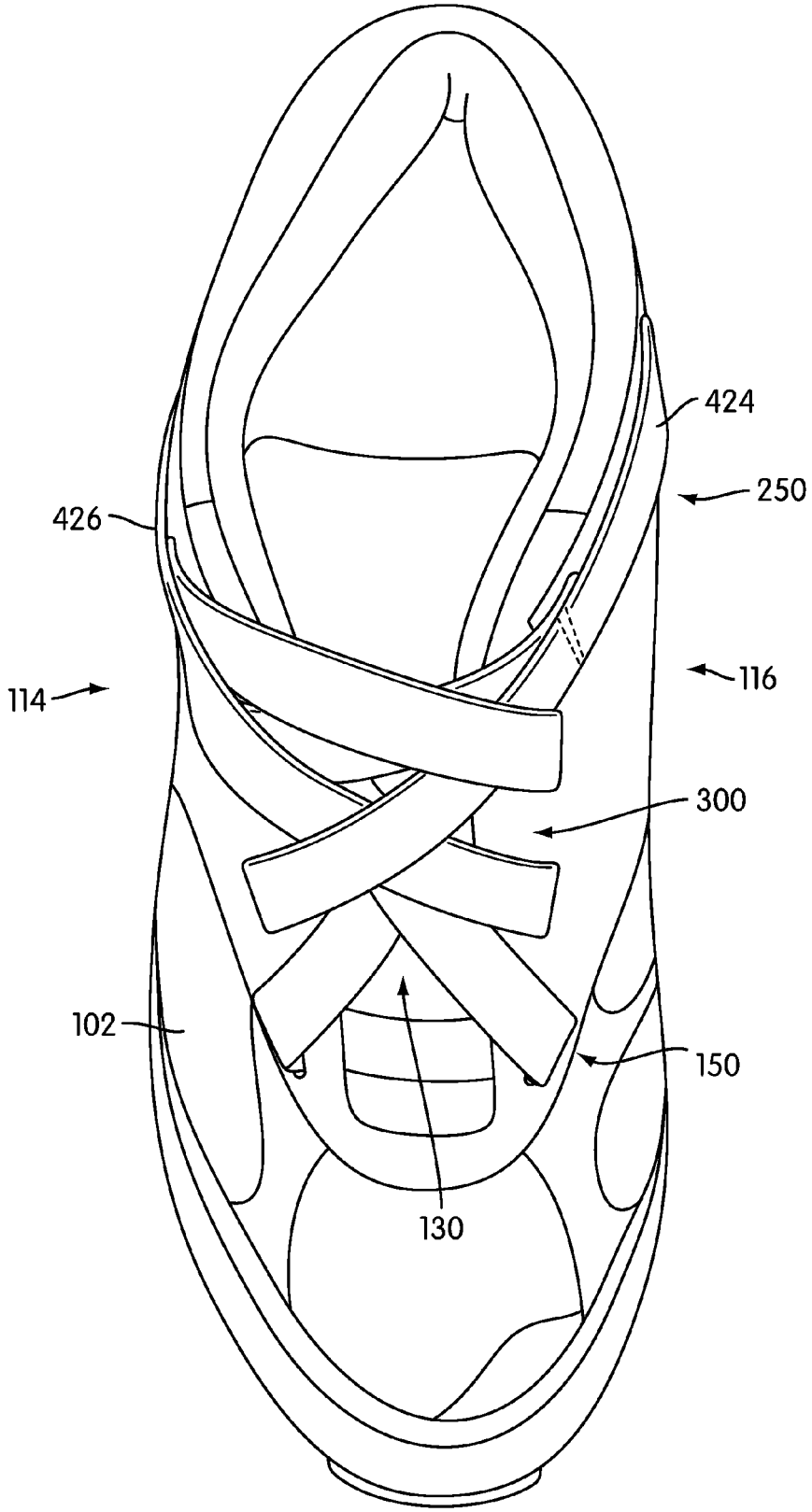
FIG. 8 is a plan view of a preferred embodiment of an article of footwear with the first lace and the second lace tightened.

FIG. 8 is a preferred embodiment of upper 102 once dual lacing system 300 has been fastened. In this embodiment, first portion 424 of second lace 250 has been fastened along medial side 116. In a similar manner, second portion 426 of second lace 250 has been fastened along lateral side 114. In a preferred embodiment, the tension applied to first portion 424 and second portion 426 of second lace 250 tightens all the various portions of first lace 150 and second lace 250.

Generally, the overlapping nature of first strap 150 and second strap 250 throughout lacing region 130 strengthens dual lacing system 300. Additionally, the overlapping nature of first strap 150 and second strap 250 gives dual lacing system 300 aesthetic appeal. Because of the preferred embodiment includes laces that may be flattened, similar to straps, dual lacing system 300 has an appearance similar to an article that has been woven along lacing region 130.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper including a first lace and a second lace;

the first lace including a first long portion and the second lace including a second long portion, an end portion of the first long portion being non-releasably attached to the second long portion, each of the first and second long portions being disposed at a first attachment region;

the first lace including a third long portion and the second lace including a fourth long portion, an end portion of the third long portion being non-releasably attached to the fourth long portion, each of the third and fourth long portions being disposed at a second attachment region;

wherein the first long portion emerges from a first slot on a medial side of the upper and extends to the first attachment region at a lateral side of the upper;

wherein the first slot is the rearmost medial-side slot through which the first lace passes;

wherein the second long portion emerges from a second slot on the medial side and extends to the first attachment region at the lateral side, wherein the second slot is closer to a front side of the upper than the first slot;

wherein the second slot is the rearmost medial-side slot through which the second lace passes;

wherein the third long portion emerges from a third slot on the lateral side and extends to the second attachment region at the medial side;

wherein the third slot is the rearmost lateral-side slot through which the first lace passes;

wherein the fourth long portion emerges from a fourth slot on the lateral side and extends to the second attachment region at the medial side, wherein the fourth slot is closer to the front side of the upper than the third slot;

wherein the fourth slot is the rearmost lateral-side slot through which the second lace passes; and wherein, between the fourth slot and the second attachment region, the fourth long portion lies one of on top of and beneath the first long portion and lies the other of on top of and beneath the second long portion.

2. The article of footwear according to claim 1, wherein the upper has a fifth slot on the lateral side and a sixth slot on the medial side;

wherein the fifth slot is closer to the front side of the upper than the fourth slot;

wherein the sixth slot is closer to the front side of the upper than the second slot;

wherein the first lace has a middle portion between the first long portion and the third long portion; and wherein the middle portion extends from the first slot on the medial side to the fifth slot on the lateral side, from the fifth slot on the lateral side to the sixth slot on the medial side, and from the sixth slot on the medial side to the third slot on the lateral side.

3. The article of footwear according to claim 1, wherein the fourth long portion lies on top of the second long portion and beneath the first long portion.

4. The article of footwear according to claim 3, wherein the first lace and the second lace are flat, and wherein the first lace and the second lace lie flat against each other where the first lace and the second lace are attached at the first attachment region and the second attachment region.

5. The article of footwear according to claim 1, wherein the upper includes six slots disposed along a lacing region.

6. The article of footwear according to claim 1, wherein an end portion of the first long portion is stitched to the second long portion, and an end portion of the third long portion is stitched to the fourth long portion.

7. The article of footwear according to claim 1, wherein the first lace and the second lace are different lengths.

8. The article of footwear according to claim 7, wherein the first lace is longer than the second lace.

9. The article of footwear according to claim 1, wherein the first slot is the rearmost slot on the medial side from which a lace emerges, and wherein the third slot is the rearmost slot on the lateral side from which a lace emerges.

10. The article of footwear according to claim 1, wherein the second long portion of the second lace includes a first fastener for releasably fastening the second lace to the lateral side of the upper, and wherein the fourth long portion of the second lace includes a second fastener for releasably fastening the second lace to the medial side of the upper.

11. The article of footwear according to claim 10, wherein the first fastener and the second fastener are adjustable to vary tension of the first lace and the second lace.

12. An article of footwear comprising:

an upper including a first lace and a second lace;

the first lace including a first long portion and the second lace including a second long portion, an end portion of the first long portion being fixedly attached to the second long portion, each of the first and second long portions being disposed at a first attachment region;

the first lace including a third long portion and the second lace including a fourth long portion, an end portion of the third long portion being fixedly attached to the fourth long portion, each of the third and fourth long portions being disposed at a second attachment region;

wherein the first long portion emerges from a first slot on a medial side of the upper and extends to the first attachment region at a lateral side of the upper;

wherein the first slot is the rearmost medial-side slot through which the first lace passes;

wherein the second long portion emerges from a second slot on the medial side and extends to the first attachment region at the lateral side, wherein the second slot is closer to a front side of the upper than the first slot;

wherein the second slot is the rearmost medial-side slot through which the second lace passes;

wherein the third long portion emerges from a third slot on the lateral side and extends to the second attachment region at the medial side;

wherein the third slot is the rearmost lateral-side slot through which the first lace passes;

wherein the fourth long portion emerges from a fourth slot on the lateral side and extends to the second attachment region at the medial side, wherein the fourth slot is closer to the front side of the upper than the third slot;

wherein the fourth slot is the rearmost lateral-side slot through which the second lace passes;

wherein, between the fourth slot and the second attachment region, the fourth long portion lies one of on top of and beneath the first long portion and lies the other of on top of and beneath the second long portion; and wherein the first long portion of the first lace ends at the first attachment region and the second long portion of the second lace extends beyond the first attachment region, and wherein the third long portion of the first lace ends at the second attachment region and the fourth long portion of the second lace extends beyond the second attachment region.

13. An article of footwear comprising:

an upper including a first lace and a second lace;

the first lace including a first long portion and the second lace including a second long portion, an end portion of the first long portion being fixedly attached to the second long portion, each of the first and second long portions being disposed at a first attachment region;

the first lace including a third long portion and the second lace including a fourth long portion, an end portion of the third long portion being fixedly attached to the fourth long portion, each of the third and fourth long portions being disposed at a second attachment region;

wherein the first long portion emerges from a first slot on a medial side of the upper and extends to a lateral side of the upper;

wherein the second long portion emerges from a second slot on the medial side and extends to the lateral side, wherein the second slot is closer to a front side of the upper than the first slot;

wherein the third long portion emerges from a third slot on the lateral side and extends to the medial side;

wherein the fourth long portion emerges from a fourth slot on the lateral side and extends to the medial side, wherein the fourth slot is closer to the front side of the upper than the third slot;

wherein the fourth long portion lies one of on top of and beneath the first long portion and lies the other of on top of and beneath the second long portion; and wherein the first long portion of the first lace ends at the first attachment region and the second long portion of the second lace extends beyond the first attachment region, and wherein the third long portion of the first lace ends at the second attachment region and the fourth long portion of the second lace extends beyond the second attachment region.

14. An article of footwear comprising:

an upper including a first slot on a medial side of the upper, a second slot on the medial side of the upper, wherein the second slot is closer to a front side of the upper than the first slot, and wherein the first slot is the rearmost medial-side slot from which a lace emerges, a third slot on a lateral side of the upper, and a fourth slot on the lateral side of the upper, wherein the fourth slot is closer to the front side of the upper than the third slot, and wherein the third slot is the rearmost lateral-side slot from which a lace emerges;

a first lace having a first end and a second end, the first lace being flat; and a second lace having a middle portion disposed between a first portion and a second portion of the second lace, the second lace being flat, wherein the first end of the first lace lies flat against the middle portion of the second lace and is fixedly attached at a first attachment region to the middle portion of the second lace adjacent to the first portion of the second lace, wherein the second end of the first lace lies flat against the middle portion of the second lace and is fixedly attached at a second attachment region to the middle portion of the second lace adjacent to the second portion of the second lace, wherein the first lace emerges from the first slot on the medial side and extends to the first attachment region on the lateral side, wherein the first lace emerges from the third slot on the lateral side and extends to the second attachment region on the medial side, wherein the second lace emerges from second slot on the medial side and extends to the first attachment region on the lateral side, wherein the second lace emerges from the fourth slot on the lateral side and extends to the second attachment region on the medial side, and wherein the second lace, in extending from the fourth slot to the second attachment region, travels one of over and under a portion of the second lace extending from the second slot to the first attachment region and the other of over and under a portion of the first lace extending from the first slot to the first attachment region.

15. The article of footwear according to claim 14, wherein the second lace travels over the portion of the second lace extending from the second slot to the first attachment region and under the portion of the first lace extending from the first slot to the first attachment region.

16. The article of footwear according to claim 14, wherein the first portion of the second lace extends beyond the second attachment region and includes a first fastener for releasably fastening the second lace to the medial side of the upper, and wherein the second portion of the second lace extends beyond the first attachment region and includes a second fastener for releasably fastening the second lace to the lateral side of the upper.

17. The article of footwear according to claim 16, wherein the first fastener and the second fastener are adjustable to vary tension of the first lace and the second lace.

18. An article of footwear comprising:

an upper including a first pair of opposing slots comprising a first slot on a lateral side of the upper and a second slot on a medial side of the upper, a second pair of opposing slots comprising a third slot on the lateral side of the upper and a fourth slot on the medial side of the upper, wherein the second pair of opposing slots is closer to a front side of the upper than the first pair of opposing slots;

a first lace having a first portion between the second slot on the medial side and a first attachment region on the lateral side, wherein the second slot is the rearmost medial-side slot through which the first lace passes, and a third portion between the first slot on the lateral side and a second attachment region on the medial side, wherein the first slot is the rearmost lateral-side slot through which the first lace passes; and a second lace having a second portion between the fourth slot on the medial side and the first attachment region on the lateral side, wherein the second portion of the second lace is non-releasably attached to the first portion of the first lace at the first attachment region, and wherein the fourth slot is the rearmost medial-side slot through which the second lace passes, and a fourth portion between the third slot on the lateral side and the second attachment region on the medial side, wherein the fourth portion of the second lace is non-releasably attached to the third portion of the first lace at the second attachment region, and wherein the third slot is the rearmost lateral-side slot through which the second lace passes, wherein the fourth portion of the second lace, in extending from the third slot to the second attachment region, travels one of over and under the second portion of the second lace and the other of over and under the first portion of the first lace.

19. The article of footwear according to claim 18, wherein the fourth portion of the second lace travels over the second portion of the second lace and under the first portion of the first lace.

20. The article of footwear according to claim 18, wherein the first portion of the first lace and the second portion of the second lace are releasably attached to the lateral side of the upper, and wherein the third portion of the first lace and the fourth portion of the second lace are releasably attached to the medial side of the upper.

21. An article of footwear comprising:

an upper including a first pair of opposing slots comprising a first slot on a lateral side of the upper and a second slot on a medial side of the upper, a second pair of opposing slots comprising a third slot on the lateral side of the upper and a fourth slot on the medial side of the upper, wherein the second pair of opposing slots is closer to a front side of the upper than the first pair of opposing slots;

a first lace having a first portion between the second slot on the medial side and a first attachment region on the lateral side, wherein the second slot is the rearmost medial-side slot through which the first lace passes, and a third portion between the first slot on the lateral side and a second attachment region on the medial side, wherein the first slot is the rearmost lateral-side slot through which the first lace passes; and a second lace having a second portion between the fourth slot on the medial side and the first attachment region on the lateral side, wherein the second portion of the second lace is attached to the first portion of the first lace at the first attachment region, and wherein the fourth slot is the rearmost medial-side slot through which the second lace passes, and a fourth portion between the third slot on the lateral side and the second attachment region on the medial side, wherein the fourth portion of the second lace is attached to the third portion of the first lace at the second attachment region, and wherein the third slot is the rearmost lateral-side slot through which the second lace passes;

wherein the fourth portion of the second lace, in extending from the third slot to the second attachment region, travels one of over and under the second portion of the second lace and the other of over and under the first portion of the first lace; and wherein the first portion of the first lace ends at the first attachment region and the second portion of the second lace extends beyond the first attachment region, and wherein the third portion of the first lace ends at the second attachment region and the fourth portion of the second lace extends beyond the second attachment region.

* * * * *